US010927715B2

(12) United States Patent
Hittle

(10) Patent No.: US 10,927,715 B2
(45) Date of Patent: Feb. 23, 2021

(54) VALVETRAIN PIVOT STAND ASSEMBLY HAVING MULTIFUNCTIONAL CAP

(71) Applicant: Caterpillar Inc., Deerfield, IL (US)

(72) Inventor: Craig Hittle, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/036,352

(22) Filed: Jul. 16, 2018

(65) Prior Publication Data

US 2020/0018194 A1 Jan. 16, 2020

(51) Int. Cl.

| | |
|---|---|
| ***F01L 1/18*** | (2006.01) |
| ***F01L 1/047*** | (2006.01) |
| ***F01L 1/08*** | (2006.01) |
| *F01L 1/26* | (2006.01) |

(52) U.S. Cl.

CPC ..... *F01L 1/182* (2013.01); *F01L 1/047* (2013.01); *F01L 1/08* (2013.01); *F01L 1/26* (2013.01); *F01L 2305/02* (2020.05)

(58) Field of Classification Search

CPC ... F01L 1/182; F01L 1/047; F01L 1/08; F01L 1/26; F01L 2105/02; F01L 1/053; F01L 1/46

USPC ..... 123/90.1, 90.27, 90.4, 90.41

See application file for complete search history.

(56) References Cited

U.S. PATENT DOCUMENTS

| | | | | |
|---|---|---|---|---|
| 5,339,778 | A * | 8/1994 | Reckzugel | F01L 1/053 123/193.5 |
| 6,125,807 | A * | 10/2000 | Nishi | F01L 1/024 123/90.27 |
| 9,309,787 | B2 | 4/2016 | Rasmussen et al. | |
| 2007/0163528 | A1* | 7/2007 | Tashiro | F01L 13/0015 123/90.23 |
| 2010/0192887 | A1* | 8/2010 | Iwata | F01L 1/022 123/90.17 |
| 2019/0078474 | A1* | 3/2019 | Lee | F01L 13/065 |
| 2019/0353058 | A1* | 11/2019 | Kim | F01L 1/181 |

FOREIGN PATENT DOCUMENTS

| | | | |
|---|---|---|---|
| JP | 2007146679 | A | 6/2007 |

* cited by examiner

*Primary Examiner* — Devon C Kramer
*Assistant Examiner* — Kelsey L Stanek
(74) *Attorney, Agent, or Firm* — Brannon Sowers & Cracraft

(57) ABSTRACT

An internal combustion engine includes a valvetrain having a pivot stand assembly that includes rocker arm assemblies and a compound pivot stand including a cap that integrates camshaft journaling and rocker arm support. The cap includes an elongate cap body structured to bolt to a base to form a camshaft journal bore, and each of a first and a second shaft bore for receiving rocker arm pivot shafts to position the rocker arms at different pivot locations. The rocker arms may be structured to actuate gas exchange valves arranged in a diamond pattern.

18 Claims, 5 Drawing Sheets

VALVETRAIN PIVOT STAND ASSEMBLY HAVING MULTIFUNCTIONAL CAP

TECHNICAL FIELD

The present disclosure relates generally to valvetrain components in an internal combustion engine, and more particularly to a cap in a pivot stand assembly in a valvetrain that integrates camshaft journaling with rocker arm support.

BACKGROUND

A valvetrain in an internal combustion engine includes the components responsible for opening and closing engine valves, including intake valves and exhaust valves. A wide variety of valvetrain designs have been known for many years. In one design, a camshaft is operated by the engine geartrain to rotate at a location underneath the engine valves. Push rods typically extend between cam followers and rocker arms that actuate the gas exchange valves. In another design the camshaft is positioned "overhead" and contacts rollers on the rocker arms directly. A pivot stand typically supports the rocker arms, at a location adjacent to a separate journal bearing and camshaft support structure.

Overhead camshaft designs have certain advantages, particularly with regard to simplicity and reduced parts as push rods and certain other components are not necessary. In some instances, however, overhead camshaft designs can be associated with restrictions in packaging and arrangement of the associated valves and valvetrain components. Use of an overhead camshaft to operate rocker arms where the associated gas exchange valves are arranged in a pattern that is not congruent with the pattern of cylinders can create packaging challenges and component loads which are sub-optimal. One known overhead camshaft design is set forth in U.S. Pat. No. 9,309,787.

SUMMARY OF THE INVENTION

In one aspect, an internal combustion engine includes an engine housing having formed therein a plurality of combustion cylinders, and a plurality of gas exchange valves for the plurality of combustion cylinders. The internal combustion engine further includes a first rocker arm assembly coupled with at least one of the plurality of gas exchange valves and including a first rocker arm and a first rocker arm pivot shaft. The internal combustion engine further includes a second rocker arm assembly coupled with at least one of the plurality of gas exchange valves and including a second rocker arm and a second rocker arm pivot shaft. The internal combustion engine further includes a camshaft coupled with each of the first and the second rocker arm assemblies, and a compound pivot stand having formed therein a journal bore, and a journal bearing positioned in the journal bore and rotatably journaling the camshaft. The compound pivot stand further has formed therein a first shaft bore receiving the first rocker arm pivot shaft to support the first rocker arm at a first pivot location, and a second shaft bore receiving the second rocker arm pivot shaft to support the second rocker arm at a second pivot location.

In another aspect, a pivot stand assembly includes a plurality of rocker arm assemblies each structured to couple with at least one gas exchange valve and including a rocker arm and a rocker arm pivot shaft. The pivot stand assembly further includes a compound pivot stand having formed therein a journal bore, and a journal bearing positioned in the journal bore for rotatably journaling a camshaft. The compound pivot stand further has formed therein a first shaft bore and a second shaft bore receiving the rocker arm pivot shafts, respectively, on a first one of the plurality of rocker arm assemblies and a second one of the plurality of rocker arm assemblies.

In still another aspect, a cap for a compound pivot stand in a valvetrain of an internal combustion engine includes an elongate one-piece cap body having a first body side face, a second body side face arranged opposite to the first body side face, and peripheral edge surfaces extending about the first body side face and the second body side face and forming a perimeter of the elongate one-piece cap body. The elongate one-piece cap body further has a body thickness extending between the first body side face and the second body side face, a body height that is greater than the body thickness, and a body length that is greater than the body height. The elongate one-piece cap body further has an arcuate cutout formed in a lower one of the peripheral edge surfaces. The arcuate cutout extends between the first body side face and the second body side face and is structured to form a camshaft journal bore with a complementary cutout in a pivot stand base. The elongate one-piece cap body further has formed therein a first shaft bore and a second shaft bore each extending between the first body side face and the second body side face. The first shaft bore is positioned at a first distance along the body length from the arcuate cutout to receive a pivot shaft for a first rocker arm to support the first rocker arm at a first pivot location relative to the camshaft. The second shaft bore is positioned at a second distance along the body length from the arcuate cutout to receive a pivot shaft for a second rocker arm to support the second rocker arm at a second pivot location relative to the camshaft.

DETAILED DESCRIPTION

Figure 1:
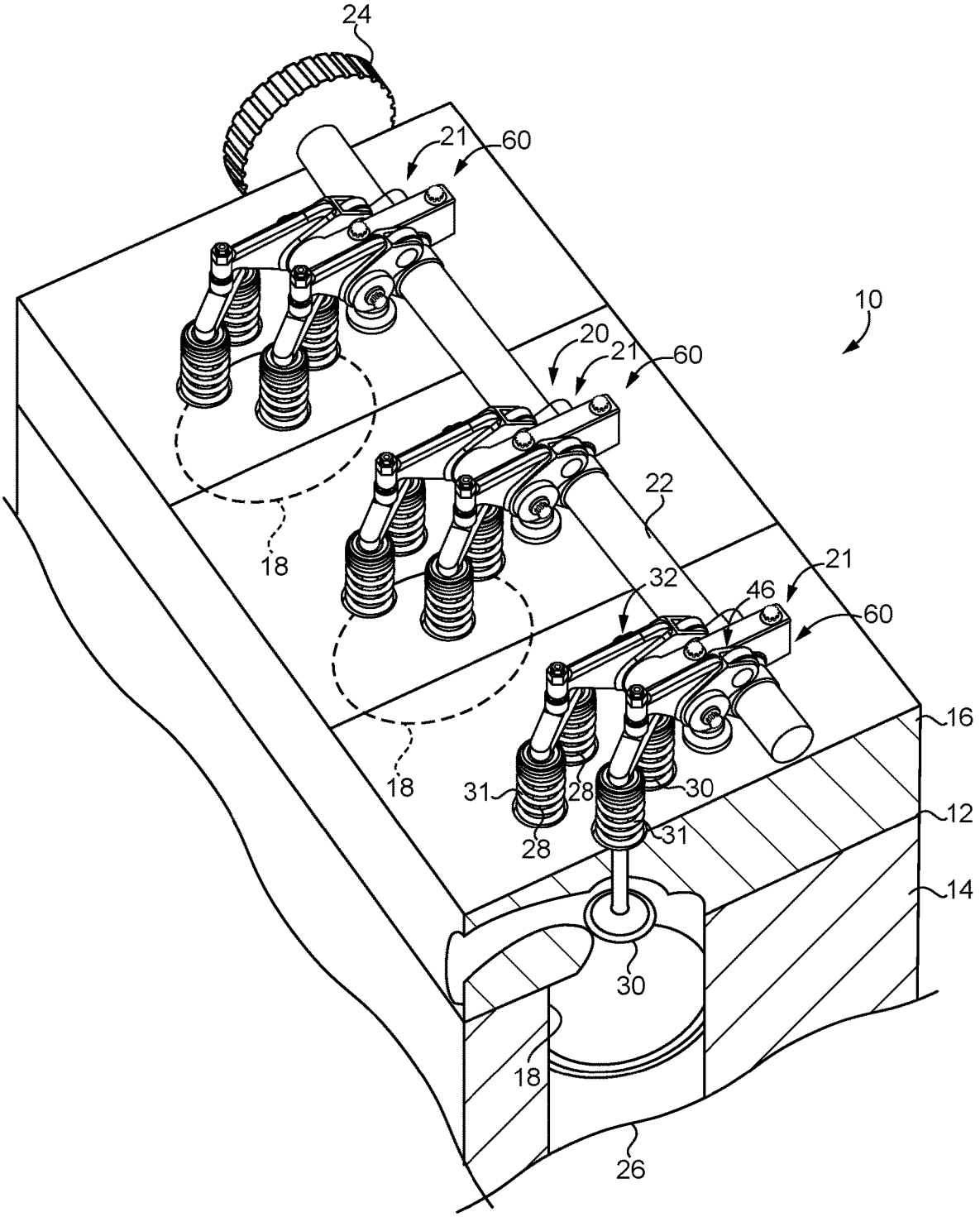
FIG. 1 is a partially sectioned view of an internal combustion engine, according to one embodiment.

Referring to FIG. 1, there is shown an internal combustion engine 10, according to one embodiment. Internal combustion engine 10 (hereinafter "engine 10") can include a compression ignition diesel engine in one embodiment, although the present disclosure is not thereby limited. Engine 10 includes a housing 12 having a cylinder block 14 and an engine head 16 coupled to cylinder block 14. A plurality of combustion cylinders 18 are formed in engine housing 12. In the illustrated embodiment three combustion cylinders 18 are shown in an in-line arrangement. Other cylinder numbers and engine architectures may fall within the scope of the present disclosure. Engine 10 further includes a valvetrain 20 including apparatus for actuating a plurality of gas exchange valves 28 and 30 for combustion cylinders 18. In the illustrated embodiment gas exchange valves 28 can include intake valves, and gas exchange valves 30 can include exhaust valves, with a total of four gas exchange valves associated with each combustion cylinder 18. Valve return springs 31 are provided for biasing gas exchange valves 28 and 30 to closed positions. Valvetrain 20 further includes a plurality of pivot stand assemblies 21 that are positioned upon engine head 16. A camshaft 22 is rotated by way of a cam gear 24 coupled with other parts of a geartrain (not shown) of engine 10. A camshaft frame and valve covers are not shown in FIG. 1 but may be included. A plurality of pivot stand assemblies 21 support multiple parts of valvetrain 20, the significance of which will be further apparent from the following description. In the illustrated arrangement camshaft 22 is provided in an overhead arrangement.

Figure 2:
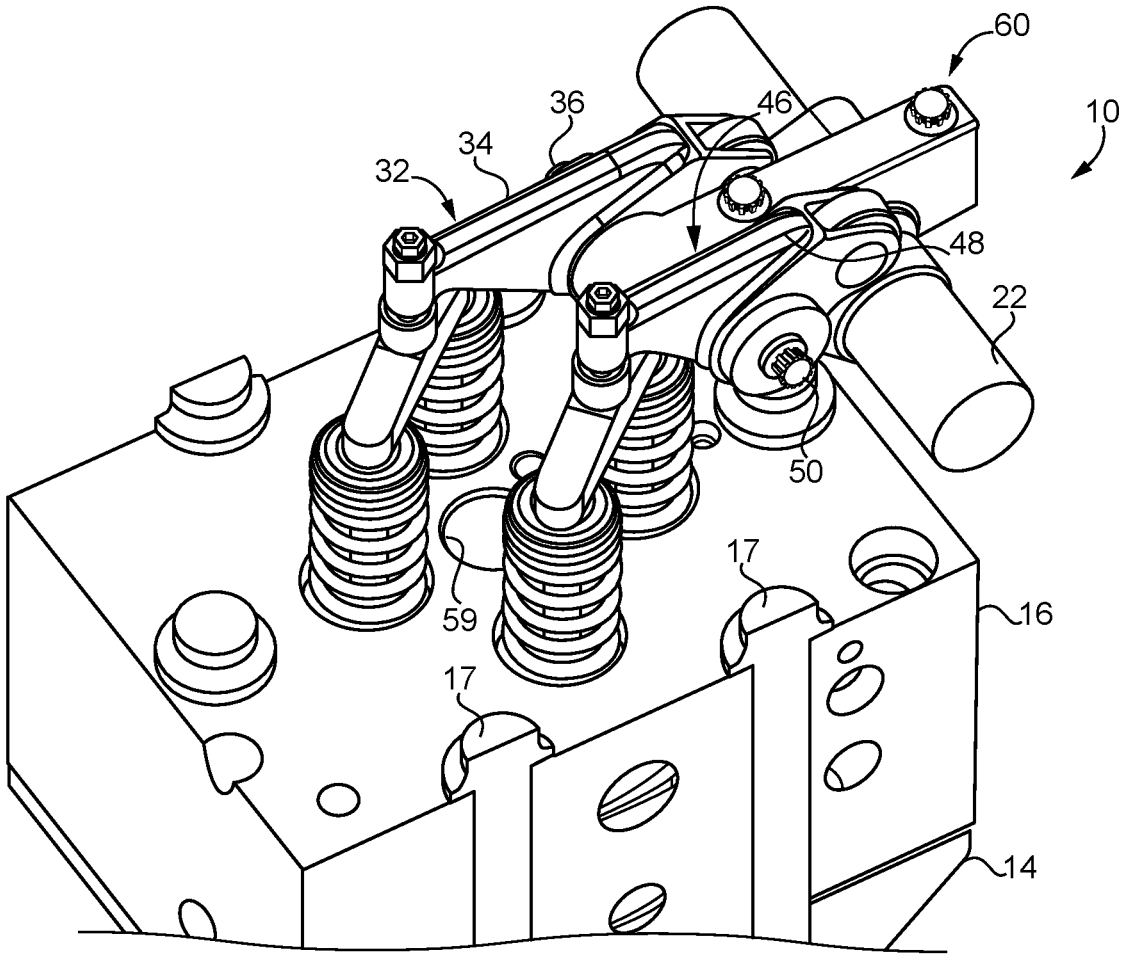
FIG. 2 is a perspective view of a portion of the engine of FIG. 1 illustrating a portion of a valvetrain.
Figure 3:
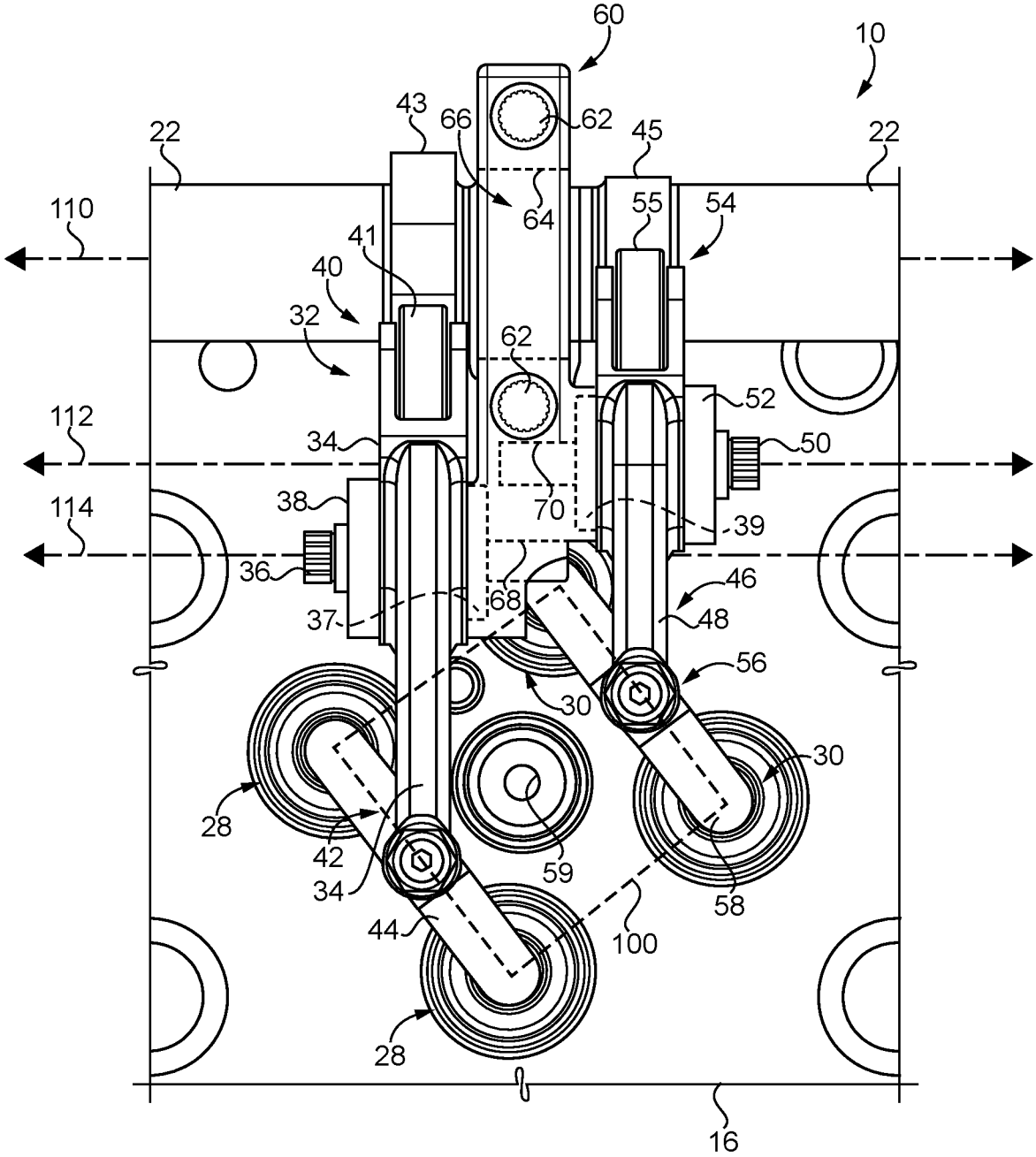
FIG. 3 is a top view of the portion of the engine shown in FIG. 2.

Valvetrain 20 further has a plurality of rocker arm assemblies including a first rocker arm assembly 32 coupled with at least one of the plurality of gas exchange valves 28, 30. Referring also now to FIGS. 2 and 3, first rocker arm assembly 32 includes a first rocker arm 34 and a first rocker arm pivot shaft 36. A second rocker arm assembly 46 is coupled with at least one of the plurality of gas exchange valves 28, 30 and includes a second rocker arm 48 and a second rocker arm pivot shaft 50. Also shown in FIG. 2 are a plurality of bolts 17 that bolt engine head 16 to cylinder block 14. A plurality of pistons 26, one of which is visible in FIG. 1, are provided and reciprocable within combustion cylinders 18 in a generally conventional manner to rotate a crankshaft (not shown) as will be well understood by those skilled in the art. A variety of coolant ports, conduits, and other features are not numbered but also shown in FIGS. 2 and 3 and may be of generally conventional purpose and design. A fuel injector opening or port 59 is shown arranged amongst gas exchange valves 28 and 30. In an implementation, engine 10 includes a direct injected engine, however, the present disclosure is also not limited in this regard.

Camshaft 22 may be rotated as noted above and is coupled with each of first rocker arm assembly 32 and second rocker arm assembly 46 to open and close gas exchange valves 28 and 30, respectively. To this end, camshaft 22 includes a first cam lobe 43 for operating first rocker arm 34, and a second cam lobe 45 for operating second rocker arm 48. First rocker arm 34 includes a roller end 40 having a roller 41 in contact with cam lobe 43, and a carrier end 42. Carrier end 42 is coupled with a carrier 44 coupled with each of gas exchange valves 28. Rocker arm assembly 32 also includes a bushing 38 positioned about pivot shaft 36. Rocker arm 48 includes a roller end 54 having a roller 55 and a carrier end 56 coupled with a carrier 58 that is in turn coupled with gas exchange valves 30. Thus, in the illustrated embodiment carrier 44 forms a first bridge connector 44 coupling first rocker arm 34 to two of the plurality of gas exchange valves 28, and carrier 58 forms a second bridge connector 58 coupling second rocker arm 48 to another two of the plurality of gas exchange valves 30. First and second bridge connectors 44 and 58 are structured, together, to position the four gas exchange valves 28 and 30 in a diamond patters, as discussed below. Rocker arm assembly 46 includes a bushing 52. The two of the plurality of gas exchange valves 28 coupled to first rocker arm 34 and the two of the plurality of gas exchange valves 30 coupled to second rocker arm 48 are arranged in a diamond pattern 100, as indicated in FIG. 3. The diamond pattern 100 could be a rhomboid pattern with equal-length sides, or a rhomboid with non-equal-length sides. First rocker arm 34 has a first length between the corresponding roller end 40 and carrier end 42, and second rocker arm 48 has a second length between the corresponding roller end 54 and carrier end 56. The first length is greater than the second length. It can thus be seen that, based on both length and pivot location, first rocker arm 34 reaches further from camshaft 22 to couple with carrier 44 approximately midway between the corresponding two gas exchange valves 28 than does rocker arm 48 to an analogous location of connection to carrier 58. In a different geometric arrangement of gas exchange valves relative to a camshaft, rocker arms might have the same reach. In still other instances, rocker arms in an engine according to the presents disclosure could have the same length, but reach to different locations of coupling to the valves by virtue of offset locations of their pivot axes. Those skilled in the art will also be familiar with the effects of a ratio of lift/drop of one end of a rocker arm to lift/drop of the opposite end of the rocker arm, or "rocker ratio." Among other things the rocker ratio can affect a shape of the cam lobes that is required. It is generally desirable to have intake cam lobes and exhaust cam lobes with similar profiles, particularly the lift profile. Similar or identical profiles can be obtained with similar or identical rocker ratios. As further discussed herein, engine 10 and valvetrain 20 are structured to enable rocker ratios within a desired range. In one embodiment, each of first rocker arm 34 and second rocker arm 48 may have a rocker ratio between 1:3 and 1:7.

Compound pivot stand 60 has formed therein a journal bore 64, and a journal bearing 66 positioned in journal bore 64 and rotatably journaling camshaft 22. Compound pivot stand 60 further has formed therein a first shaft bore 68 receiving first pivot shaft 36 to support first rocker arm 34 at a first pivot location, and a second shaft bore 70 receiving second pivot shaft 50 to support second rocker arm 48 at a second pivot location. Enabling the offset of the pivot locations in contrast to certain conventional designs can assist in achieving rocker ratios within the desired range. As suggested above, this capability may be advantageously applied where a total of four gas exchange valves are arranged in a diamond pattern. Camshaft 22 defines a camshaft axis 110. First shaft bore 68 defines a first shaft bore axis 114 at an outboard location relative to camshaft axis 110, and second shaft bore 70 defines a second shaft bore axis at an inboard location, relative to camshaft axis 110. Axes 114 and 112 can be collinear with pivot axes of pivot shaft 36 and pivot shaft 50, respectively. It can be observed that in addition to the offset bore/pivot shaft axes, compound pivot stand 60 provides the additional function of rotatably journaling camshaft 22. In earlier designs camshaft journal support structure was separated from rocker arm pivot stand support structure.

Figure 4:
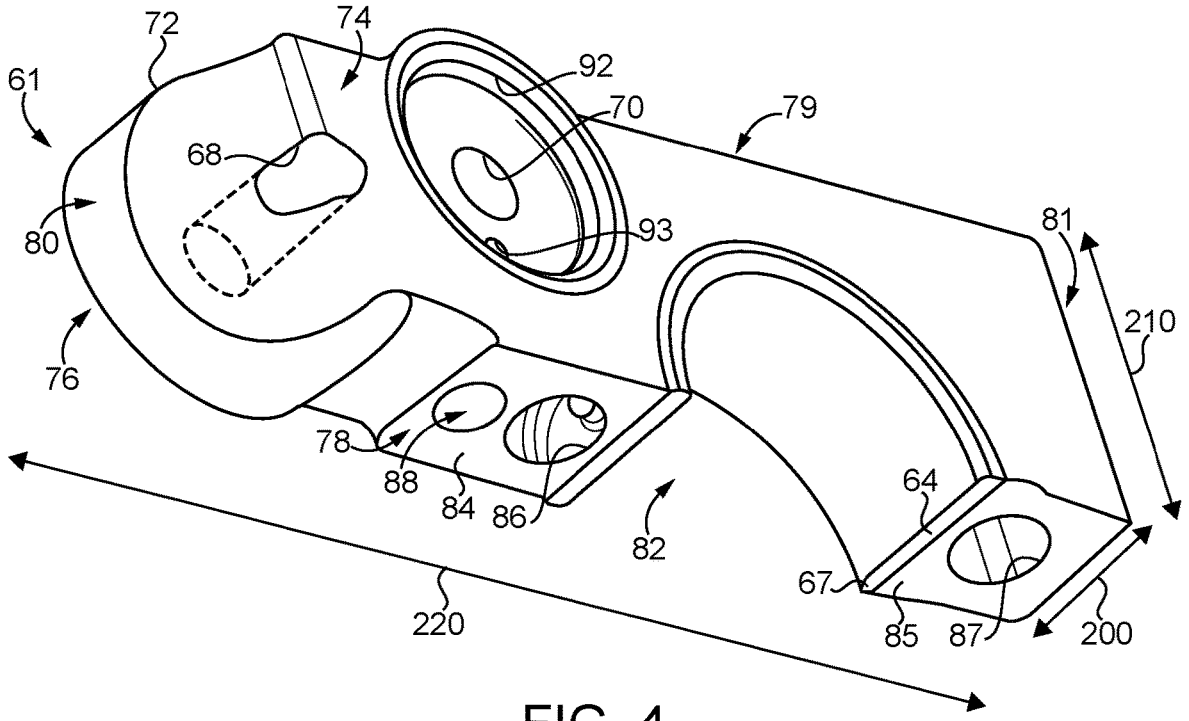
FIG. 4 is a perspective view of a cap for a compound pivot stand, according to one embodiment.
Figure 5:
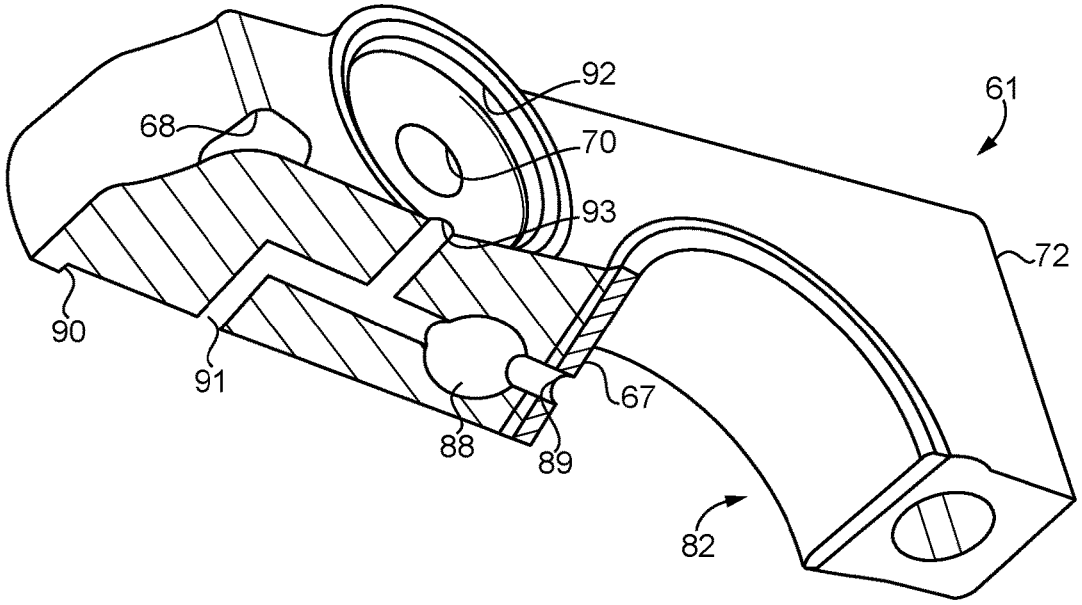
FIG. 5 is a partially sectioned view, in perspective, of the cap of FIG. 4.
Figure 6:
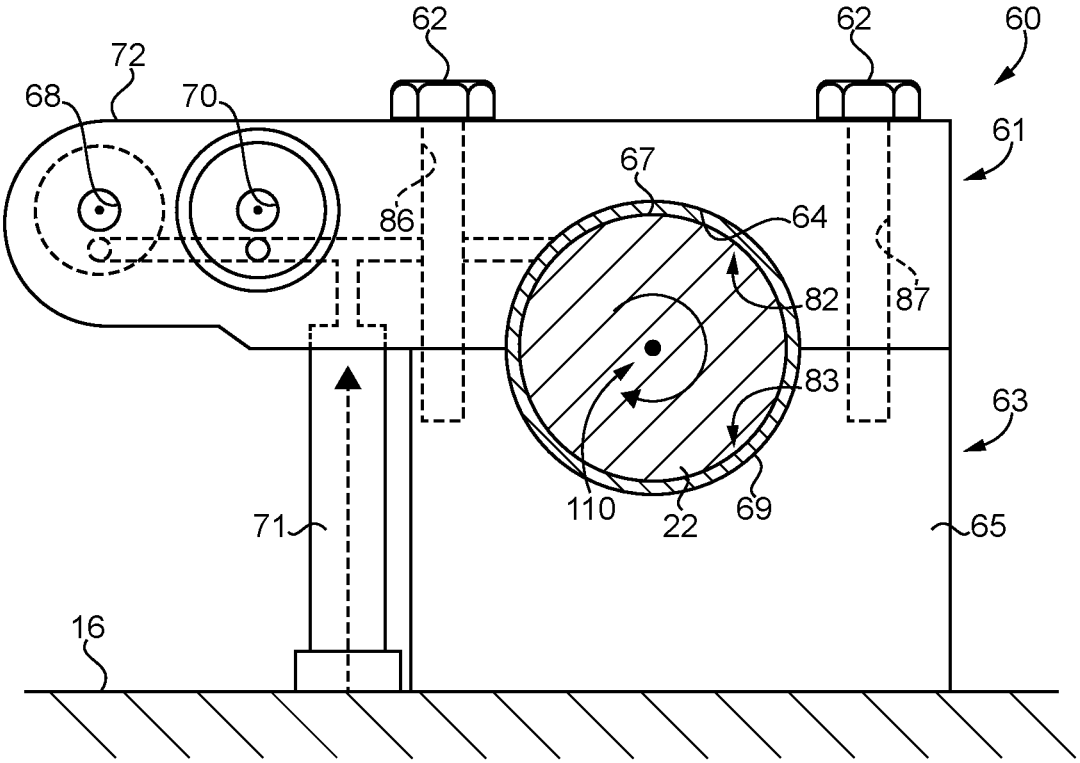
FIG. 6 is a partially sectioned view through a valvetrain, according to one embodiment.

Referring also to FIGS. 4, 5, and 6, compound pivot stand 60 includes a cap 61 and bolts 62 bolting cap 61 to a base 63. Base 63 can include a first base piece 65 forming journaling structure for camshaft 22, and a second base piece 71 serving as a support and also an oil supply. Cap 61 may be formed by a one-piece elongate cap body 72. First shaft bore 68 and second shaft bore 70 may each be formed in cap 61. Journal bearing 66 can include a journal bearing half round 67 located in cap 61 and a journal bearing half round 69 located in base 63. Base 63 could all be one piece, or separate pieces, bolted on to engine head 16, or formed entirely or in part integrally with engine housing 12.

As noted above, cap 61 includes an elongate one-piece cap body 72. Elongate one-piece cap body 72 (hereinafter "cap body 72"), has a first body side face 74, a second body side face 76 arranged opposite to first body side face 74, and a plurality of peripheral edge surfaces extending about first body side face 74 and second body side face 76 and forming a perimeter of cap body 72. The peripheral edge surfaces can include a lower one of the peripheral edge surfaces 78, an upper one of the peripheral edge surfaces 79, a first end surface 80, and a second end surface 81. Cap body 72 further has a body thickness 200 extending between first body side face 74 and second body side face 76, a body height 210 that is greater than body thickness 200 and extends between lower peripheral edge surface 78 and upper peripheral edge surface 79, and a body length 220 that is greater than body height 210 and extends between end surface 80 and end surface 81. Cap body 72 further includes an arcuate cutout 82 formed in lower peripheral edge surface 78. Arcuate cutout 82 extends between first body side face 74 and second body side face 76 and is structured to form camshaft journal bore 64 with a complementary cutout 83 formed in base 63. Journal bearing half round 67 is fitted within arcuate cutout 82. Cap body 72 further has formed therein first shaft bore 68 and second shaft bore 70, which each extend between first body side face 74 and second body side face 76. First shaft bore 68 and second shaft bore 70 can be located at approximately the same height location in cap body 72. Arcuate cutout 82 and each of shaft bores 68 and 70 extend horizontally through cap body 72. It can be noted from the drawings that first shaft bore 68 is positioned at a first distance along body length 220 from arcuate cutout 82 to receive pivot shaft 36 for first rocker arm 34 to support first rocker arm 34 at a first pivot location relative to camshaft 22. Second shaft bore 70 is positioned at a second distance along body length 220 from arcuate cutout 82 to receive pivot shaft 50 for second rocker arm 48 to support second rocker arm 48 at a second pivot location relative to camshaft 22. Lower peripheral edge surface 78 further includes a first bolting face 84 located on a first side of arcuate cutout 82 and a second bolting face 85 located on a second side of arcuate cutout 82. A first vertical bolting hole 86 extends between first bolting face 84 and upper peripheral edge surface 79. A second bolting hole 87 extends between second bolting face 85 and upper peripheral edge surface 79. Any number of bolts and bolting holes could be used.

In one implementation, an oil passage 88 is formed in cap body 72 and extends to first bolting face 84 or second bolting face 85. In the FIG. 4 embodiment it can be seen that oil passage 88 opens at bolting face 84. Cap body 72 further includes a disc-shaped inset 90 formed in body side face 76, to receive a first bushing 37 coupled with first rocker arm 34, and another disc-shaped inset 92 formed in body side face 74 to receive a second bushing 39 coupled with second rocker arm 48. Disc-shaped inset 90 extends circumferentially around first shaft bore 68 and connects to oil passage 88 by way of an oil port 91. Disc-shaped inset 92 extends circumferentially around second shaft bore 70 and connects to oil passage 88 by way of an oil port 93. It can also be seen that oil passage 88 connects to arcuate cutout 82 by way of yet another oil port 89 so as to provide lubricating oil to bearing 66. Lubricating oil can be supplied up through pivot stand base 63, such as through base piece 71, to enter oil passage 88 in bolting face 84. Other oil-supply strategies and oil supply locations are also contemplated herein.

INDUSTRIAL APPLICABILITY

During operation of engine 10 fuel and air can be delivered to, compressed, combusted, and expelled as exhaust from each combustion cylinder 18 by way of the cooperative action of each piston 26 and gas exchange valves 28 and 30 in a well-known manner. Moving gas exchange valves 28 and 30 between open positions and closed positions occurs by way of the reciprocating, pivoting action of rocker arm assembly 32 and rocker arm assembly 46, and the others of a plurality of rocker arm assemblies in engine 10. Rotation of cam gear 24 in response to rotation of an engine crankshaft operates camshaft 22 to move rocker arm assemblies 32 and 46 in the described manner. As suggested above, in certain earlier strategies rocker arm ratios could be other than optimal, creating packaging issues or causing other problems. The present disclosure enables rocker arms to be supported by a common support apparatus while still positioning the pivot shafts at different distances from the camshaft 22 to avoid excessive rocker ratios or other problems. This is achieved in an integrated structure that also assists in rotatably journaling the subject camshaft 22.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An internal combustion engine comprising:

an engine housing having formed therein a plurality of combustion cylinders;

a plurality of gas exchange valves for the plurality of combustion cylinders;

a first rocker arm assembly coupled with at least one of the plurality of gas exchange valves and including a first rocker arm and a first rocker arm pivot shaft;

a second rocker arm assembly coupled with at least one of the plurality of gas exchange valves and including a second rocker arm and a second rocker arm pivot shaft;

a camshaft defining a camshaft axis and coupled with each of the first and the second rocker arm assemblies; and a compound pivot stand having formed therein a journal bore, and a journal bearing positioned in the journal bore and rotatably journaling the camshaft;

the compound pivot stand further having formed therein a first shaft bore receiving the first rocker arm pivot shaft to support the first rocker arm at a first pivot location, and a second shaft bore receiving the second rocker arm pivot shaft to support the second rocker arm at a second pivot location;

the compound pivot stand further having a first end surface located upon a first outboard side of the journal bore, and a second end surface located upon a second outboard side of the journal bore that is opposite to the first outboard side; and each of the first pivot location and the second pivot location is upon the first outboard side of the journal bore and spaced, in a direction normal to the camshaft axis, a first distance and a second distance, respectively, from the journal bore, the first distance being different from the second distance.

2. The internal combustion engine of claim 1 wherein the first shaft bore defines a first shaft bore axis at an outboard location and the second shaft bore defines a second shaft bore axis at an inboard location, relative to the camshaft axis.

3. The internal combustion engine of claim 1 wherein the first rocker arm assembly includes a first bridge connector coupling the first rocker arm to two of the plurality of gas exchange valves, and a second bridge connector coupling the second rocker arm to another two of the plurality of gas exchange valves.

4. The internal combustion engine of claim 3 wherein the two of the plurality of gas exchange valves coupled to the first rocker arm and the two of the plurality of gas exchange valves coupled to the second rocker arm are arranged in a diamond pattern.

5. The internal combustion engine of claim 4 wherein:

each of the first rocker arm and the second rocker arm includes a roller end having a roller in contact with the camshaft, and a connector end coupled with the corresponding first or second bridge connector; and the first rocker arm has a first length between the corresponding roller end and connector end, and the second rocker arm has a second length between the corresponding roller end and connector end, and the first length is greater than the second length.

6. The internal combustion engine of claim 5 wherein each of the first rocker arm and the second rocker arm has a rocker ratio between 1:3 and 1:7.

7. The internal combustion engine of claim 1 wherein the compound pivot stand includes a base and a cap bolted to the base.

8. The internal combustion engine of claim 7 wherein the first shaft bore and the second shaft bore are each formed in the cap, and the journal bearing includes a journal bearing half round located in the base and a journal bearing half round located in the cap.

9. A pivot stand assembly comprising:

a plurality of rocker arm assemblies each structured to couple with at least one gas exchange valve and including a rocker arm and a rocker arm pivot shaft;

a compound pivot stand having formed therein a journal bore, and a journal bearing positioned in the journal bore for rotatably journaling a camshaft; and the compound pivot stand further having formed therein a first shaft bore and a second shaft bore receiving the rocker arm pivot shafts, respectively, of a first one of the plurality of rocker arm assemblies and a second one of the plurality of rocker arm assemblies;

the rocker arm of the first rocker arm assembly and the rocker arm of the second rocker arm assembly each have a rocker ratio between 1:3 and 1:7; and a length of the rocker arm of the first rocker arm assembly is greater than a length of the rocker arm of the second rocker arm assembly.

10. The pivot stand assembly of claim 9 wherein the compound pivot stand includes a base, a cap, and a plurality of bolts bolting the cap to the base.

11. The pivot stand assembly of claim 10 wherein the journal bore extends horizontally through the compound pivot stand and is formed in part within the cap and in part within the base, and wherein a first vertical bolting hole is formed on a first side of the journal bore and a second vertical bolting hole is formed on a second side of the journal bore.

12. The pivot stand assembly of claim 11 wherein the first shaft bore extends horizontally through the compound pivot stand and defines a first shaft bore axis at an outboard location and the second shaft bore extends horizontally through the compound pivot stand and defines a second shaft bore axis at an inboard location, relative to the journal bore.

13. The pivot stand assembly of claim 9 wherein the first one of the plurality of rocker arm assemblies includes a first bridge connector, and the second one of the plurality of rocker arm assemblies includes a second bridge connector structured together with the first bridge connector to position four gas exchange valves in a diamond pattern.

14. A cap for a compound pivot stand in a valvetrain of an internal combustion engine comprising:

an elongate one-piece cap body having a first body side face, a second body side face arranged opposite to the first body side face, and peripheral edge surfaces extending about the first body side face and the second body side face and forming a perimeter of the elongate one-piece cap body;

the elongate one-piece cap body further having a body thickness extending between the first body side face and the second body side face, a body height that is greater than the body thickness, and a body length that is greater than the body height;

the elongate one-piece cap body further having an arcuate cutout formed in a lower one of the peripheral edge surfaces, the arcuate cutout extending between the first body side face and the second body side face and being structured to form a camshaft journal bore with a complementary cutout in a pivot stand base;

the elongate one-piece cap body further having formed therein a first shaft bore and a second shaft bore each extending between the first body side face and the second body side face;

the first shaft bore being positioned at a first distance, in an outboard direction, along the body length from the arcuate cutout to receive a pivot shaft for a first rocker arm to support the first rocker arm at a first pivot location relative to the camshaft; and the second shaft bore being positioned at a second distance, in the outboard direction, along the body length from the arcuate cutout to receive a pivot shaft for a second rocker arm to support the second rocker arm at a second pivot location relative to the camshaft, and the second distance is less than the first distance.

15. The cap of claim 14 wherein:

the lower one of the peripheral edge surfaces further includes a first bolting face located on a first side of the arcuate cutout and a second bolting face located on a second side of the arcuate cutout; and a first bolting hole extends between the first bolting face and an upper one of the peripheral edge surfaces and a second bolting hole extends between the second bolting face and a lower one of the peripheral edge surfaces.

16. The cap of claim 15 wherein an oil passage is formed in the elongate one-piece cap body and extends to the first bolting face or the second bolting face.

17. The cap of claim 16 wherein:

the elongate one-piece cap body further includes a disc-shaped inset formed in the first body side face to receive a bushing coupled with the second rocker arm, and a disc-shaped inset formed in the second body side face to receive a bushing coupled with the first rocker arm; and the disc-shaped inset in the first body side face extends circumferentially around the second shaft bore and connects to the oil passage, and the disc-shaped inset formed in the second body side face extends circumferentially around the first shaft bore and connects to the oil passage.

18. The cap of claim 16 further comprising a bearing half round fitted within the arcuate cutout, and wherein the oil passage connects to the arcuate cutout.

* * * * *